US008312603B2

(12) United States Patent
Chou

(10) Patent No.: US 8,312,603 B2
(45) Date of Patent: Nov. 20, 2012

(54) BUCKLE FOR SWIMMING/DIVING GOGGLES

(76) Inventor: Terry Chou, Tainan (TW)

( * ) Notice: Subject to any disclaimer, the term of this patent is extended or adjusted under 35 U.S.C. 154(b) by 100 days.

(21) Appl. No.: 13/052,078

(22) Filed: Mar. 20, 2011

(65) Prior Publication Data

US 2012/0233825 A1 Sep. 20, 2012

(51) Int. Cl.
*A44B 11/26* (2006.01)

(52) U.S. Cl. ..... 24/170; 24/191; 24/193; 24/636; 2/426; 2/448

(58) Field of Classification Search ..... 24/170, 24/265 BC, 68 SK, 71 SR, 629, 636, 637, 24/68 E, 191, 193; 2/426, 428, 448, 909; 351/43

See application file for complete search history.

(56) References Cited

U.S. PATENT DOCUMENTS 3,043,902 A * 7/1962 Klein ..... 174/146
6,871,386 B2 * 3/2005 Chen-Lieh ..... 24/168
7,146,653 B2 * 12/2006 Chou ..... 2/426
7,571,520 B2 * 8/2009 Shiue ..... 24/265 BC
7,631,400 B2 * 12/2009 Chiang ..... 24/170
7,921,476 B2 * 4/2011 Chiang ..... 2/448
8,225,430 B2 * 7/2012 Chiang ..... 2/448
2008/0189837 A1 * 8/2008 Chiang ..... 2/431
2009/0100645 A1 * 4/2009 Weng ..... 24/170
2009/0229086 A1 * 9/2009 Chiang ..... 24/170

* cited by examiner

*Primary Examiner* — Robert J Sandy
*Assistant Examiner* — Rowland D Do

(57) ABSTRACT

A buckle includes a base engaged with a body of swimming/diving goggle. A head strap is extended through a slot in a rear end of the base. A cover is engaged with the body. A space is defined between the cover and the base. A button is mounted in a groove of the cover and made of flexible material. An engagement plate is formed on the button and includes a catch releasably engaging with teeth of the head strap. First and second supporting points are defined between the button and the base. A pressing section is formed between the first and second supporting points. The catch can be disengaged from the teeth of the head strap to allow movement of the head strap in a loosening direction by pressing the pressing section or manually moving the grip.

2 Claims, 7 Drawing Sheets

BUCKLE FOR SWIMMING/DIVING GOGGLES

BACKGROUND OF THE INVENTION

The present invention relates to a buckle for swimming/diving goggles and, more particularly, to a buckle for swimming/diving goggles allowing easy adjustment of a head strap.

Swimming goggles generally include two lenses, two frames, a bridge, a buckle, and a head strap. The buckle allows adjustment of a length of the head strap. FIG. 8 shows a conventional buckle 1' including an end with an engagement portion 11' for engagement with a body 3' of a pair of swimming goggles. The other end of the buckle 1' includes a coupling portion 12' for coupling with a soft head strap 2'. The coupling portion 12' includes pegs 121' and 122' at an intermediate portion thereof. A notch 123' is defined in a front end of the coupling portion 12'. The head strap 2' is extended between the notch 123' and the peg 121' and wound around the pegs 121' and 122' and extended between the notch 123' and the peg 121' again, fixing the head strap 2'. When adjustment of the head strap 2' is required, the user removes the body 3' from his or her head, loosens the head strap 2', and adjusts the length of the head strap 2', which is troublesome and time-consuming. However, the length of the head strap 2' after adjustment may not fit the head of the user. As a result, readjustment of the head strap 2' is required when the head strap 2' is either too tight or too loose. Furthermore, the head strap 2' deforms significantly at the bends wound around the pegs 121' and 122'.

FIG. 9 shows another pair of conventional swimming goggles including a buckle 5' mounted to a side of a body 4 for engaging with a head strap 6'. The buckle 5' includes a base 51', a cover 52', and a button 53'. The button 53' includes a shaft 531' pivotably connected to the base 51'. The button 53' further includes an end having a catch 532' for engaging with teeth 61' of the head strap 6'. The button 53' includes an abutment end 533' abutting a resilient portion 41' of the body 4'. The resilient portion 41' is made of the same material as the body 4'. When the button 53' is not pressed, the catch 532' is engaged with the teeth 61' of the head strap 6', allowing movement of the head strap 6' in a single direction for tightening purposes. On the other hand, the button 53' can be pressed to disengage the catch 532' from the head strap 6', allowing the head strap 6' to move in the reverse direction for loosening the head strap 6'. Thus, the head strap 6' can be adjusted easily. The elasticity of the resilient portion 41' supports the catch 532' in engagement with the teeth 61' of the head strap 6'. An example of such a buckle is shown in U.S. Pat. No. 7,020,904 (Taiwan Patent Publication No. 586435). However, the resilient portion 41' is made of the same material as the padding portion 42' of the body 4' that is too soft to stably support the abutment end 533'. As a result, the catch 532' can not reliably engage with the teeth 61' of the head strap 6'. On the other hand, if the resilient portion 41' is made of a rigid material to provide reliable support, the button 53' and the padding portion 42' will be too ridge for the face of the user, resulting in discomfort.

FIG. 10 shows a further pair of conventional swimming goggles including a buckle 8' mounted to a side of a body 7'. The buckle 8' includes a shaft 81' around which a head strap 6' is wound. The buckle 8' further includes a pressing member 82' abutting a side of a frame of the body 7'. Furthermore, the buckle 8' includes a catch 821' for engaging with the teeth 61' of the head strap 6'. A grip 822' is provided on an outer side of the pressing member 82' for manually moving the catch 821' between an engagement position engaged with the teeth 61' allowing tightening of the head strap 6' in a single direction and a disengagement position disengaged from the teeth 61' allowing loosening of the head strap 6' in the reverse direction. An example of such a b buckle is shown in U.S. Pat. No. 7,251,842 (Taiwan Utility Model No. M296059). However, the frame of the body 7' is made of soft material and, thus, provides unreliable support for engagement between the catch 821' and the teeth 61'. Furthermore, the head strap 6' can only be loosened by pivoting the pressing member 82', leading to inconvenience in use.

BRIEF SUMMARY OF THE INVENTION

An objective of the present invention is to provide a buckle for swimming goggles with operational convenience, wider application, and reliable engagement.

A buckle for swimming/diving goggles according to the present invention is adapted to be mounted to a side of a body of the swimming/diving goggles and adapted to engage with a head strap including a plurality of teeth. The buckle includes a base having a front end with an engagement portion engaged with the side of the body. The base further includes a rear end having a slot. The head strap is adapted to extend through the slot. The base further includes a support portion adjacent to the front end of the base. A cover includes a front end having an engagement portion engaged with the side of the body. The cover covers the base, and a space is defined between the cover and the base. The cover further includes a groove extending from a rear end of the cover towards but spaced from the front end of the cover. The groove includes an opening in the rear end of the cover. A button is mounted in the groove of the cover and made of flexible material. The button includes an inner face. An engagement plate is formed on the inner face of the button and aligned with the slot of the base. The engagement plate includes a catch for releasably engaging with the teeth of the head strap. The button further includes front and rear ends. A grip is provided on the rear end of the button and is received in the opening of the cover. First and second supporting points are defined between the button and the base. A pressing section is formed between the first and second supporting points. The front end of the button abuts against the support portion of the base to retain the catch in engagement with the teeth of the head strap to only allow movement of the head strap in a tightening direction. The button is pressable at the pressing section to disengage the catch from the teeth of the head strap to allow movement of the head strap in a loosening direction opposite to the tightening direction. The space receives the pressed pressing section. The grip is manually operable to disengage the catch from the teeth of the head strap to allow movement of the head strap in the loosening direction.

Preferably, with each of the plurality of teeth of the head strap includes a slanted face and a stop face opposite to the slanted face. The catch of the button is engageable with the stop face of the plurality of teeth of the head strap to retain the head strap.

In an example, the base includes two pivot seats formed on an inner face thereof and located behind the support portion. Each of the two pivot seats of the cover has a first recess. An abutment plate is provided on the inner face of the cover. The second supporting point is located between the abutment plate and the button. The cover includes an inner face having two pivotal seats each having a second recess. The button includes an inner face having a protrusion pivotally engaged with the two pivot seats of the cover and the two pivot seats of the base. The protrusion includes two cylindrical ends received in the first and second recesses. The first supporting point is located between the two cylinders and the base.

In another example, the button includes two pivot seats formed on an inner face of the button and each having a recess. An abutment plate is provided on the inner face of the button. The second supporting point is located between the abutment plate and the base. The base includes an inner face having a protrusion pivotally engaged with the two pivot seats of the button. The protrusion includes two cylindrical ends received in the recesses. The first supporting point is located between the two cylinders and the button.

The present invention will become clearer in light of the following detailed description of illustrative embodiments of this invention described in connection with the drawings.

DETAILED DESCRIPTION OF THE INVENTION

Figure 1:
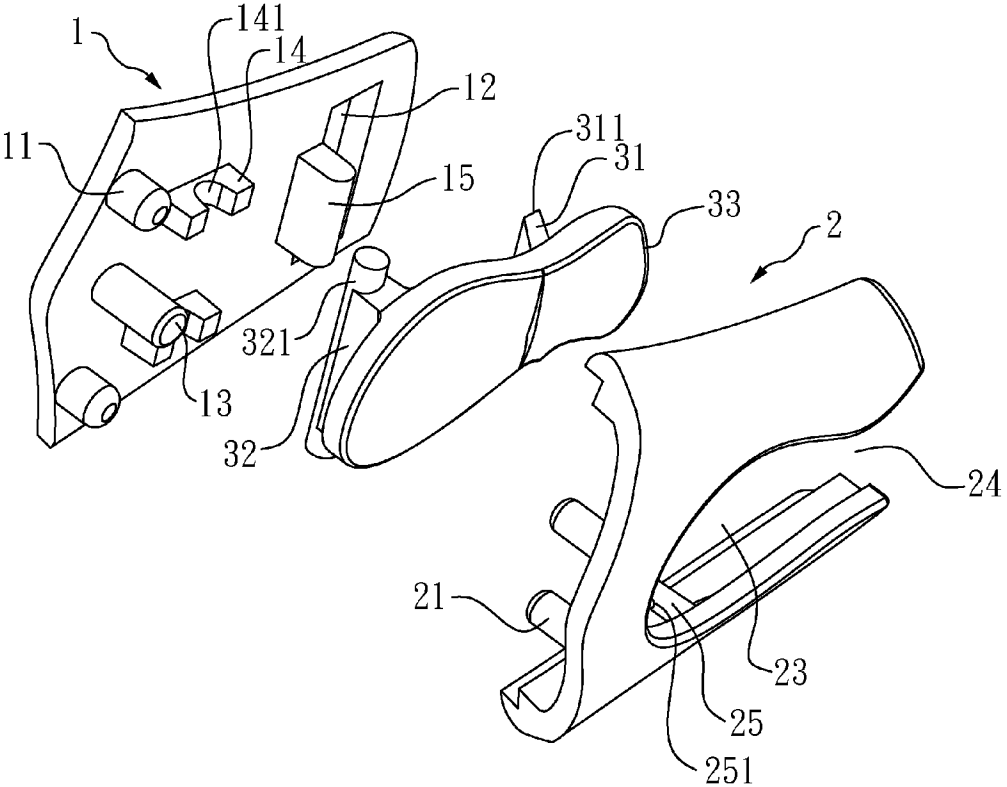
FIG. 1 shows an exploded, perspective view of a buckle for swimming/diving goggles according to the present invention.
Figure 2:
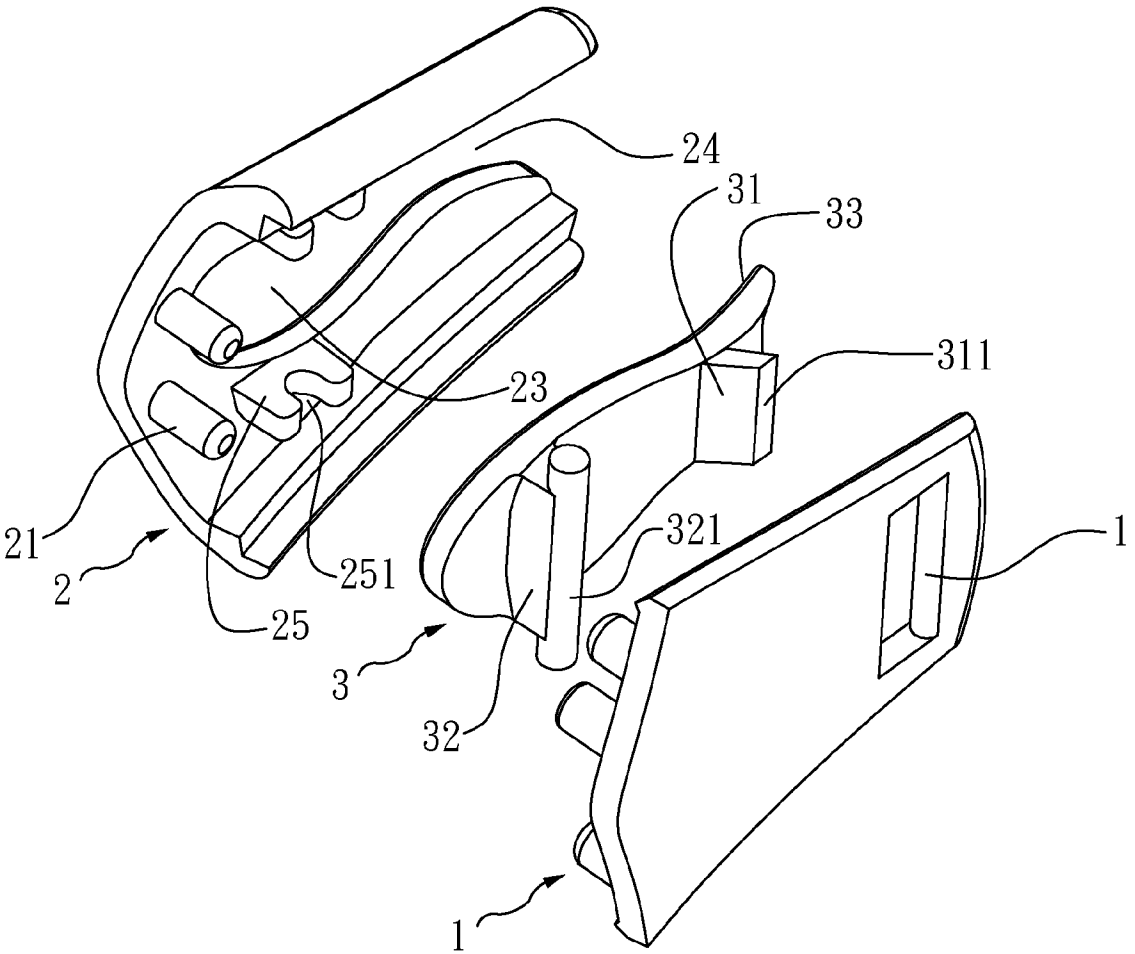
FIG. 2 shows another exploded, perspective view of the buckle of FIG. 1.
Figure 3:
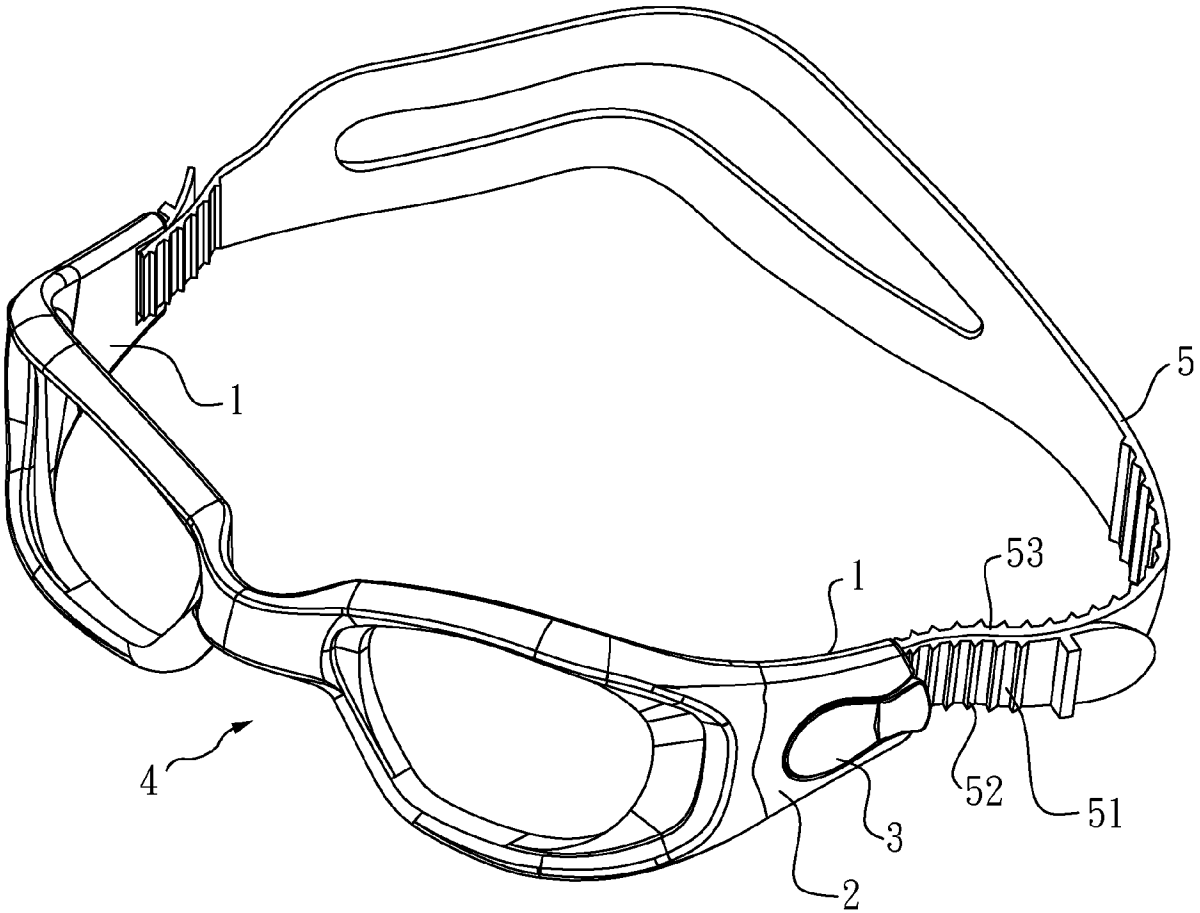
FIG. 3 shows a perspective view of swimming/diving goggles with the buckle of FIG. 1.

With reference to FIGS. 1-4, a buckle according to the present invention is mounted to a side of a body 4 of swimming/diving goggles for coupling with a head strap 5 that includes a plurality of teeth 51 on a side thereof. Each tooth 51 includes a slanted face 511 and a stop face 512 opposite to the slanted face 511. The buckle according to the present invention includes a base 1, a cover 2, and a button 3. The base 1 includes a front end having an engagement portion 11 engaged with the body 4. A slot 12 is defined in a rear end of the base 1. The head strap 5 is extended through the slot 12. A support portion 13 is formed on an inner face of the base 10 and located adjacent to the front end. Two pivot seats 14 are provided on the inner face and located behind the support portion 13. Each pivot seat 14 has a recess 141. An abutment plate 15 is provided on the top face of the base 10 and located adjacent to the rear end of the base 10.

The cover 2 includes a front end having an engagement portion 21 engaged with the body 4. After engagement, the cover 2 covers the base 1, and a space 22 is defined between the cover 2 and the base 1 to allow movement of the button 3 when the button 3 is pressed. The cover 2 includes a groove 23 extending from a center of a rear end of the cover 2 towards but spaced from a front end of the cover 2. The groove 23 has an opening 24 in the rear end of the cover 2. Two pivot seats 25 are formed on an inner face of the cover 2 and aligned with the pivot seats 14 of the base 1. Each pivot seat 25 includes a recess 251.

The button 3 is mounted in the groove 23 of the cover 2 and made of flexible material. An engagement plate 31 is provided on an inner face of the button 3 and aligned with the slot 12 of the base 1. The engagement plate 31 includes a catch 311 on an end thereof for engagement with the stop face 512 of one of the teeth 51 of the head strap 5. A protrusion 32 is provided on a front end of the inner face of the button 3 for pivotal engagement with the pivot seats 14 and 25 of the base 1 and the cover 2. The protrusion 32 includes two cylindrical ends 321 received in the grooves 141 and 251, allowing the button 3 to pivot relative to the base 1 and the cover 2. The button 3 further includes a rear end having a grip 33.

The engagement portions 11 and 21 of the base 1 and the cover 2 are engaged with the side of the body 4. The button 3 is mounted in the opening 23 of the cover 2 with the cylindrical ends 321 of the protrusion 32 received in the grooves 141 and 251 of the pivot seats 14 and 25 of the base 1 and the cover 2 and with the grip 33 received in the opening 24 of the cover 2. Two supporting points a and b are formed between the button 3 and the base 1. Specifically, the first supporting point a is located between the cylindrical ends 321 and the base 1, and the second supporting point b is located between the distal end of the abutment plate 15 and the button 3. A pressing section 34 is formed between the first and second supporting points a and b.

Figure 4:
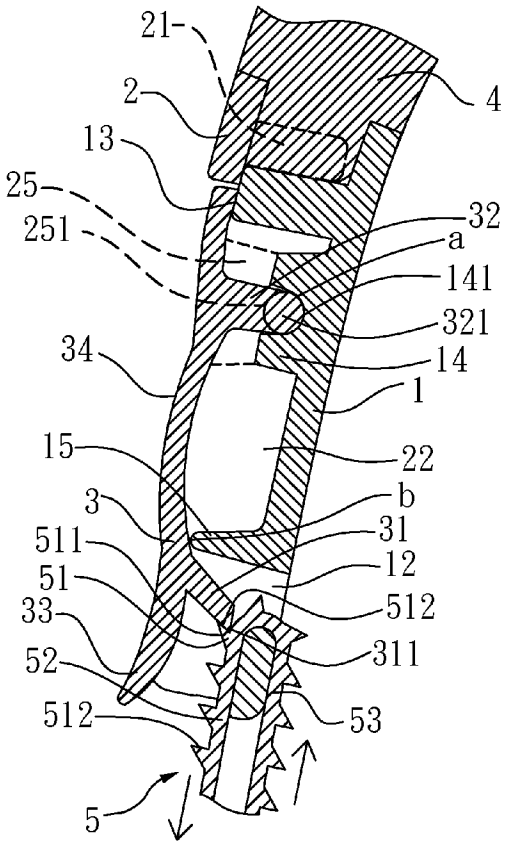
FIG. 4 shows a cross sectional view of a portion of the swimming/diving goggles of FIG. 3, illustrating adjustment of tightness of a head strap.

The head strap 5 is extended through the slot 12 and includes inner and outer sections 52 and 53. The front end of the button 3 abuts against the support portion 13 of the base 1, and the engagement plate 31 faces the head strap 5. The catch 311 of the button 3 engages with the stop face 512 of one of the teeth 51 of the head strap 5, as shown in FIG. 4. In this state, the head strap 5 can only be pulled in a tightening direction indicated by the arrows for tightening the head strap 5. The slanted faces 511 of the teeth 51 of the head strap 5 allows smooth pulling of the head strap 5 in the tightening direction. When the head strap 5 is released, the catch 311 reliably engages with the stop face 512 of another tooth 51 of the head strap 5 due to abutment of the front end of the button 3 against the support portion 13 of the base 1.

Figure 5:
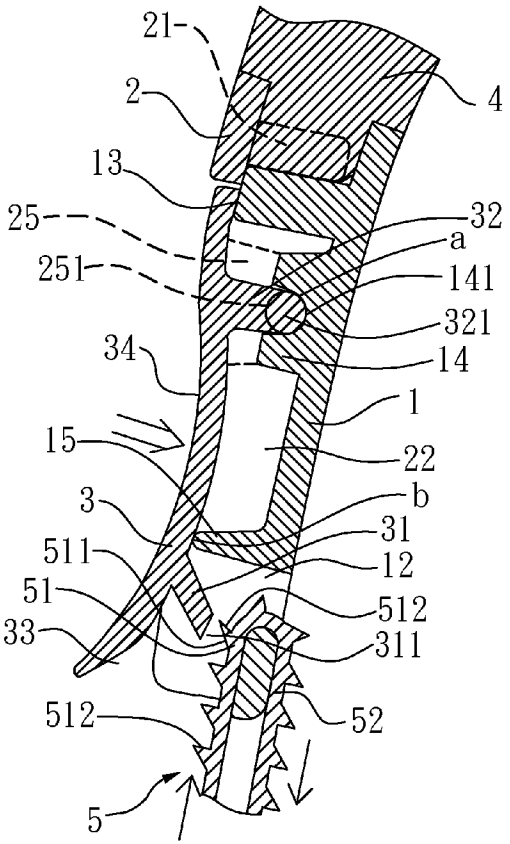
FIG. 5 is a view similar to FIG. 4, wherein a button of the buckle is pressed to allow loosening of the head strap.

With reference to FIG. 5, when it is desired to loosen the head strap 5, the user can press the pressing section 34 of the button 3 into the space 22. The cylindrical ends 321 of the protrusion 32 at the first supporting point a pivot, such that force is imparted to the second supporting point b, leading to outward movement of the catch 311 of the engagement plate 31 away from the head strap 5. Thus, the catch 311 is disengaged from the teeth 51 of the head strap 5, allowing loosening of the head strap 5 in the loosening direction.

Figure 6:
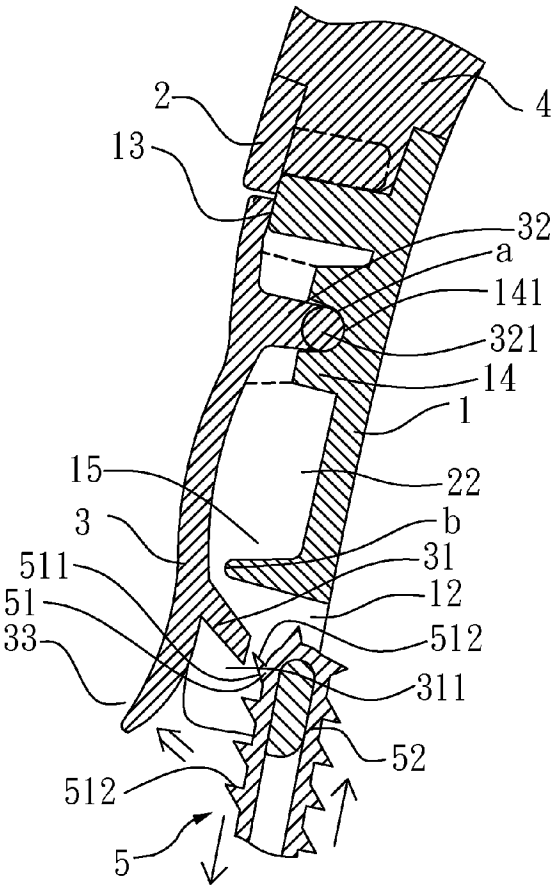
FIG. 6 is a view similar to FIG. 4, wherein the button is pivoted to a position allowing loosening of the head strap.
Figure 8:
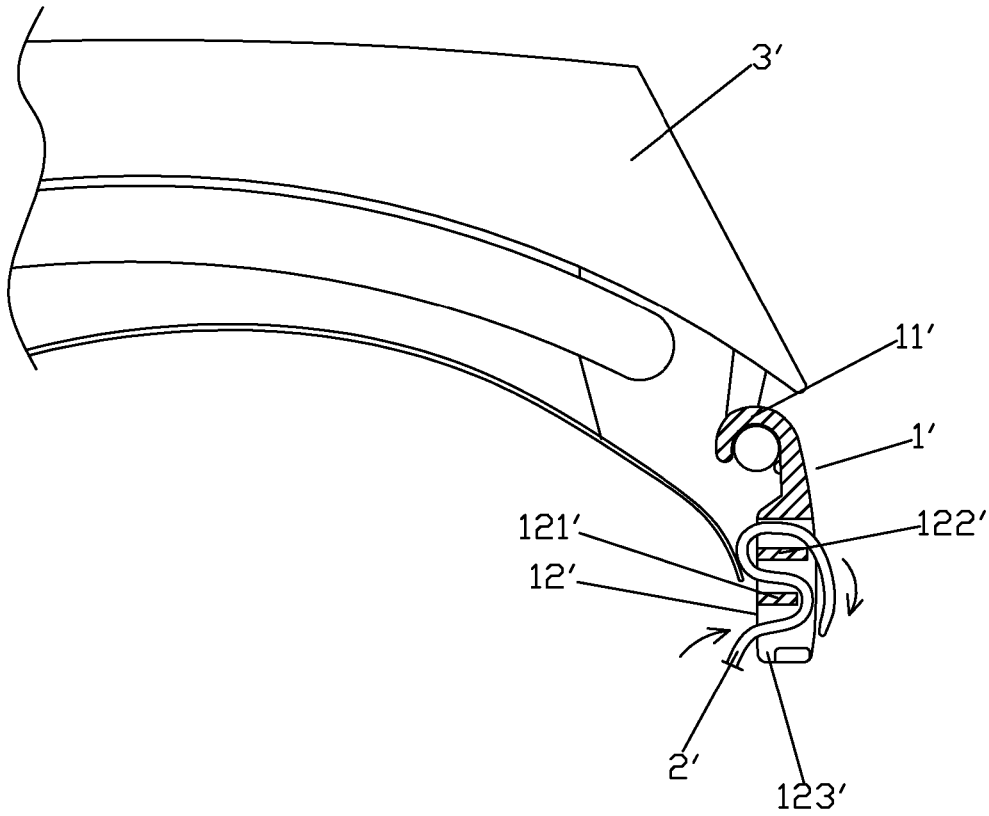
FIG. 8 (PRIOR ART)
FIG. 8 shows a portion of a pair of conventional swimming goggles.
Figure 9:
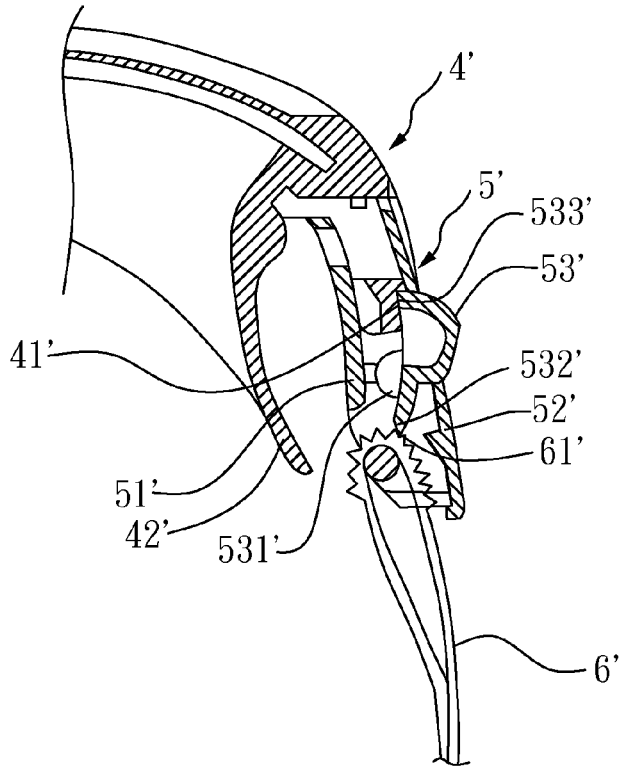
FIG. 9 (PRIOR ART)
FIG. 9 shows a portion of another pair of conventional swimming goggles.
Figure 10:
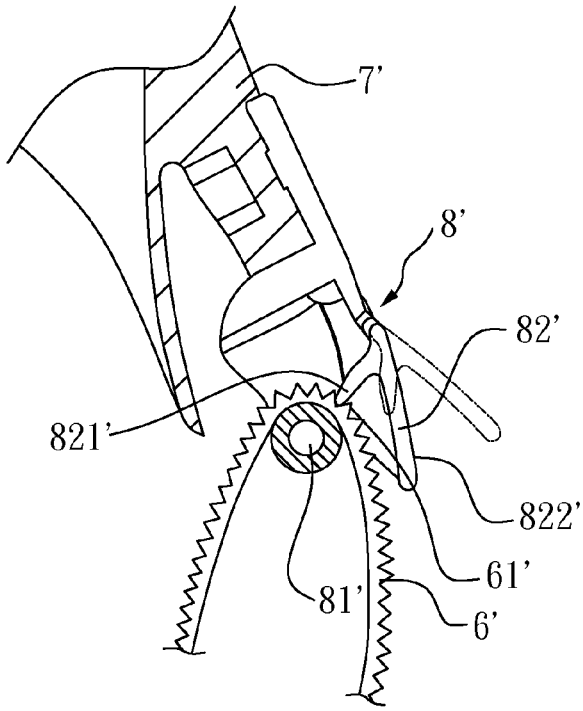
FIG. 10 (PRIOR ART)
FIG. 10 shows a portion of a further pair of conventional swimming goggles.

With reference to FIG. 6, another option of loosening the head strap 5 is manually moving the grip 33 of the button 3 away from the head strap 5 to disengage the catch 311 from the teeth 51. Thus, the buckle allows easy adjustment of the tightness of the head strap 5 by providing two options for the user, providing wider application and operational convenience. Furthermore, instead of support from the frame of the body of the conventional swimming goggles, the buckle according to the present invention provides reliable positioning for the head strap 5 by the abutment between the button 3 and the support portion 13 of the cover 1.

Figure 7:
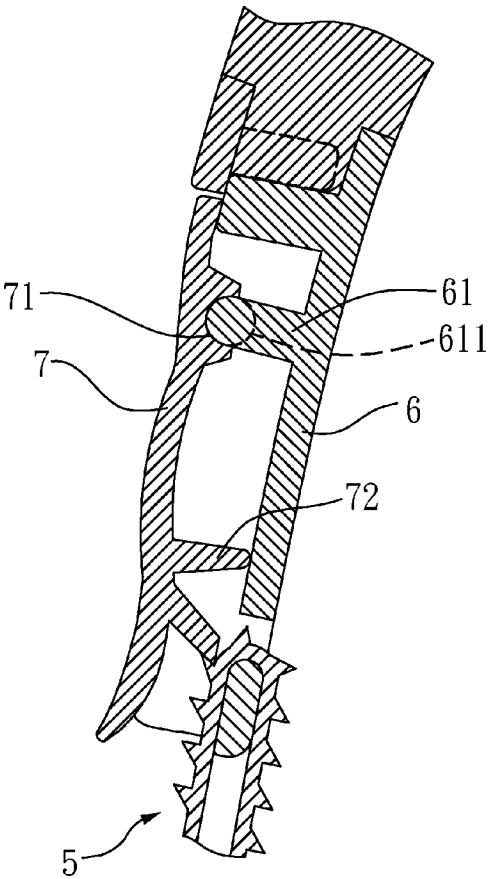
FIG. 7 is a view similar to FIG. 4, illustrating a modified example of the buckle according to the present invention.

FIG. 7 shows a modified example of the buckle, wherein the top face of the base (now designed by 6) includes an inner face having a protrusion 61 with two cylindrical ends 611. The inner face of the button (now designed by 7) includes two pivot seats 71 having recesses 711 for receiving the cylindrical ends 611. An abutment plate 72 is provided on a rear end of the button 7. Thus, the button 7 and the base 1 also form two supporting points. The button 7 can be either pressed or directly moved away from the head strap 5 by operating the grip of the button 7, allowing loosening of the head strap 5.

The buckle according to the present invention allows easy adjustment of the tightness of the head strap 5 with operational convenience and stable positioning. The base 1, 6 and the cover 2 can be mounted to the side of swimming/diving goggles by integral formation, coupling, or other suitable provisions.

Although specific embodiments have been illustrated and described, numerous modifications and variations are still possible without departing from the essence of the invention. The scope of the invention is limited by the accompanying claims.

The invention claimed is:

1. A buckle for swimming/diving goggles, with the buckle adapted to be mounted to a side of a body of the swimming/diving goggles and adapted to engage with a head strap including a plurality of teeth, with the buckle comprising:

a base including a front end having an engagement portion engaged with the side of the body, with the base further including a rear end having a slot, with the head strap adapted to extend through the slot, with the base further including a support portion adjacent to the front end of the base;

a cover including a front end having an engagement portion engaged with the side of the body, with the cover covering the base, with a space defined between the cover and the base, with the cover further including a groove extending from a rear end of the cover towards but spaced from the front end of the cover, with the groove including an opening in the rear end of the cover; and a button mounted in the groove of the cover and made of flexible material, with the button including an inner face, with an engagement plate formed on the inner face of the button and aligned with the slot of the base, with the engagement plate including a catch for releasably engaging with the teeth of the head strap, with the button further including front and rear ends, with a grip provided on the rear end of the button, with the grip received in the opening of the cover, with first and second supporting points defined between the button and the base, with a pressing section formed between the first and second supporting points, with the front end of the button abutting against the support portion of the base to retain the catch in engagement with the teeth of the head strap to only allow movement of the head strap in a tightening direction, with the button being pressable at the pressing section to disengage the catch from the teeth of the head strap to allow movement of the head strap in a loosening direction opposite to the tightening direction, with the space receiving the pressed pressing section, with the grip being manually operable to disengage the catch from the teeth of the head strap to allow movement of the head strap in the loosening direction, with the base including two pivot seats formed on an inner face thereof and located behind the support portion, with each of the two pivot seats of the base having a first recess, with an abutment plate provided on the inner face of the base, with the second supporting point located between the abutment plate and the button, with the cover including an inner face having two pivotal seats each having a second recess, with the button including an inner face having a protrusion pivotally engaged with the two pivot seats of the cover and the two pivot seats of the base, with the protrusion including two cylindrical ends received in the first and second recesses, with the first supporting point located between the two cylinders and the base.

2. A buckle for swimming/diving goggles, with the buckle adapted to be mounted to a side of a body of the swimming/diving goggles and adapted to engage with a head strap including a plurality of teeth, with the buckle comprising:

a base including a front end having an engagement portion engaged with the side of the body, with the base further including a rear end having a slot, with the head strap adapted to extend through the slot, with the base further including a support portion adjacent to the front end of the base;

a cover including a front end having an engagement portion engaged with the side of the body, with the cover covering the base, with a space defined between the cover and the base, with the cover further including a groove extending from a rear end of the cover towards but spaced from the front end of the cover, with the groove including an opening in the rear end of the cover; and a button mounted in the groove of the cover and made of flexible material, with the button including an inner face, with an engagement plate formed on the inner face of the button and aligned with the slot of the base, with the engagement plate including a catch for releasably engaging with the teeth of the head strap, with the button further including front and rear ends, with a grip provided on the rear end of the button, with the grip received in the opening of the cover, with first and second supporting points defined between the button and the base, with a pressing section formed between the first and second supporting points, with the front end of the button abutting against the support portion of the base to retain the catch in engagement with the teeth of the head strap to only allow movement of the head strap in a tightening direction, with the button being pressable at the pressing section to disengage the catch from the teeth of the head strap to allow movement of the head strap in a loosening direction opposite to the tightening direction, with the space receiving the pressed pressing section, with the grip being manually operable to disengage the catch from the teeth of the head strap to allow movement of the head strap in the loosening direction, with the button including two pivot seats formed on an inner face of the button and each having a recess, with an abutment plate provided on the inner face of the button, with the second supporting point located between the abutment plate and the base, with the base including an inner face having a protrusion pivotally engaged with the two pivot seats of the button, with the protrusion including two cylindrical ends received in the recesses, with the first supporting point located between the two cylinders and the button.

* * * * *